US008927954B2

(12) United States Patent
Zibouche et al.

(10) Patent No.: US 8,927,954 B2
(45) Date of Patent: Jan. 6, 2015

(54) PACKAGING DEVICE FOR THE TRANSPORT AND/OR STORAGE OF A RADIOACTIVE MEDIUM

(75) Inventors: Mohamed Zibouche, Bagnols sur Ceze (FR); Florent Ferry, St Victor la Coste (FR); Patrick Jacot, Villeneuve les Avignon (FR)

(73) Assignee: TN International, Montigny le Bretonneux (FR)

( * ) Notice: Subject to any disclaimer, the term of this patent is extended or adjusted under 35 U.S.C. 154(b) by 475 days.

(21) Appl. No.: 13/263,987

(22) PCT Filed: Apr. 13, 2010

(86) PCT No.: PCT/EP2010/054778
§ 371 (c)(1),
(2), (4) Date: Dec. 1, 2011

(87) PCT Pub. No.: WO2010/119015
PCT Pub. Date: Oct. 21, 2010

(65) Prior Publication Data

US 2012/0067761 A1 Mar. 22, 2012

(30) Foreign Application Priority Data

Apr. 14, 2009 (FR) ..... 09 52433

(51) Int. Cl.
*G21F 5/00* (2006.01)
*G21F 5/002* (2006.01)

(52) U.S. Cl.
CPC ..... *G21F 5/002* (2013.01); *G21Y 2004/30* (2013.01); *G21Y 2002/207* (2013.01); *G21Y 2002/50* (2013.01); *G21Y 2002/60* (2013.01)
USPC ..... 250/506.1; 250/505.1; 250/507.1

(58) Field of Classification Search
None
See application file for complete search history.

(56) References Cited

U.S. PATENT DOCUMENTS

| | | | | | |
|---|---|---|---|---|---|
| 3,701,900 | A | * | 10/1972 | Thuler | 250/462.1 |
| 3,845,315 | A | * | 10/1974 | Blum | 250/506.1 |
| 3,926,176 | A | * | 12/1975 | Winchell et al. | 600/8 |
| 3,957,033 | A | * | 5/1976 | Winchell et al. | 600/431 |
| 4,120,414 | A | * | 10/1978 | Harrison et al. | 215/307 |
| 4,299,659 | A | * | 11/1981 | Hame et al. | 376/272 |
| 4,404,165 | A | * | 9/1983 | Hesky et al. | 376/272 |

(Continued)

FOREIGN PATENT DOCUMENTS

| | | | | | |
|---|---|---|---|---|---|
| EP | 0197235 | A1 | | 10/1986 | |
| JP | 01006896 | A | * | 1/1989 | G21F 9/02 |
| JP | 03231200 | A | * | 10/1991 | G21F 9/36 |
| WO | 2006138239 | A2 | | 12/2006 | |

OTHER PUBLICATIONS

International Search Report, PCT/EP2010/054778, dated Aug. 30, 2010.

*Primary Examiner* — Andrew Smyth
(74) *Attorney, Agent, or Firm* — Nixon Peabody LLP

(57) ABSTRACT

A packaging device for the transport and/or storage of a radioactive medium generating flammable gases and/or explosives via radiolysis, comprising a plurality of canisters intended to contain the radioactive medium, each canister defining an inner storage space accessible via an opening for filling the medium, on which plug-forming means are mounted. According to the invention, the device also comprises a structure forming a chamber, and means for placing in communication allowing a fluid communication to be set up between the inner storage space and the chamber.

18 Claims, 15 Drawing Sheets

(56) References Cited

U.S. PATENT DOCUMENTS

| | | | | | |
|---|---|---|---|---|---|
| 4,672,213 | A * | 6/1987 | Stoll et al. | 250/506.1 |
| 4,747,512 | A * | 5/1988 | Lo | 220/592.25 |
| 5,102,615 | A * | 4/1992 | Grande et al. | 376/272 |
| 5,273,088 | A * | 12/1993 | Cripe et al. | 141/329 |
| 5,299,243 | A * | 3/1994 | Picco | 376/287 |
| 5,464,988 | A * | 11/1995 | Rossmassler et al. | 250/507.1 |
| 5,491,345 | A * | 2/1996 | Stoutenburgh | 250/506.1 |
| 5,767,422 | A * | 6/1998 | Brassell et al. | 73/864.74 |
| 5,790,622 | A * | 8/1998 | Steinberg et al. | 376/450 |
| 6,608,319 | B2 * | 8/2003 | Joseph | 250/519.1 |
| 2002/0069936 | A1 * | 6/2002 | Shaw et al. | 141/318 |
| 2002/0101953 | A1 * | 8/2002 | Hettiarachchi et al. | 376/306 |
| 2002/0185614 | A1 * | 12/2002 | Joseph | 250/507.1 |
| 2004/0124374 | A1 * | 7/2004 | Joseph | 250/507.1 |
| 2005/0105675 | A1 * | 5/2005 | Sitaraman et al. | 376/305 |
| 2005/0132597 | A1 * | 6/2005 | Ladre et al. | 34/218 |
| 2008/0017644 | A1 * | 1/2008 | Wickland et al. | 220/319 |
| 2011/0095208 | A1 * | 4/2011 | Abadie et al. | 250/507.1 |

* cited by examiner

PACKAGING DEVICE FOR THE TRANSPORT AND/OR STORAGE OF A RADIOACTIVE MEDIUM

CROSS REFERENCE TO RELATED APPLICATIONS OR PRIORITY CLAIM

This application is a National Phase of PCT/EP2010/054778, filed Apr. 13, 2010, entitled, "PACKAGING DEVICE FOR STORING AND/OR WAREHOUSING RADIOACTIVE PRODUCTS", and which claims priority of French Patent Application No. 09 52433, filed Apr. 14, 2009, the contents of which are incorporated herein by reference in their entirety.

TECHNICAL FIELD

The present invention generally relates to the field of the transport and/or storage of a radioactive medium generating flammable gases and/or explosives via radiolysis, such as hydrogen.

These may be radioactive media of various kinds, such as for example:

a radioactive liquid medium;

a powder of plutonium oxide (PuO2) or mixed uranium-plutonium oxide (UO2-PUO2), also called MOX powder, with a moisture content higher than 0.5% for example;

technological waste comprising organic compounds and possibly water, this waste possibly being contaminated with uranium or plutonium imparting a radioactive nature to such materials;

nuclear fuel rods that are not sealed, irradiated or fresh, possibly containing water;

sections of nuclear fuel rods comprising resin to entrap the radioactive material.

STATE OF THE PRIOR ART

In manner known per se, said radioactive medium is usually placed in an inner storage space defined by a canister. When several canisters are filled and then sealed by plugs they are then arranged on a canister basket and inserted in a cavity defined by an overpack. The assembly obtained, called a package for storage and transport of radioactive materials may for example comprise ten canisters distributed within the canister basket.

A liquid radioactive medium, which usually comprises plutonium, is liable to generate flammable gases and/or explosives such as hydrogen via radiolysis. This can be attributed to the fact that the radioactive medium, whether it is a liquid in which the radioactive material is in ionic form and/or in the form of solid particles dispersed in the liquid, forms an emitter of $\alpha$-particles which, in particular, have the particularity of dissociating the hydrogenated molecules to release flammable gaseous compounds. In this respect, it is noted that the molecules decomposed by radiolysis may be part of the medium and/or of the constituent material of the canister.

In either case, when their concentration exceeds a limit value called the <<flammability threshold>>, the flammable gases produced by radiolysis, in the presence of other gases such as air, form an explosive mixture. The flammability threshold varies depending on the type of flammable gas and depending on temperature and pressure conditions. In the particular case of hydrogen, the flammability threshold in air is in the region of 4%. This means that when the concentration of hydrogen in air exceeds this threshold, a source of heat or a spark would be sufficient to ignite the mixture or to produce a violent explosion within the inner storage space, this space effectively only being partly filled with the radioactive medium and completed with a gaseous headspace.

Yet, various studies have shown that the concentration of flammable gases, such as hydrogen, produced by radiolysis in a canister comprising a plutonium-containing aqueous medium, may sometimes reach values of around 4% after a few days. However, canisters frequently remain sealed for much longer periods before being opened. There is therefore a real accident risk since a spark caused by impacts or friction may occur during transport within the inner space of the canister containing the gaseous headspace. In addition, this risk subsists during canister opening operations.

To confront this problem, the volume of radioactive medium placed in the canister can be reduced. This allows the obtaining of a larger volume of gaseous headspace in which the flammability threshold of the flammable gases is reached at a later stage. Nonetheless, this solution does not prove to be satisfactory from an economic viewpoint, since it multiplies transport operations.

Another solution could consist of maintaining the same volume of radioactive medium in the canister, but enlarging the inner storage space so as to increase the volume of gaseous headspace. However, this leads to manufacturing canisters of very large size, which makes the use thereof more difficult in particular during the loading phases of the radioactive medium into the canister, which are generally conducted in glove boxes.

This type of drawback also arises with the other radioactive media mentioned above, if they are liable to generate flammable gases and/or explosives via radiolysis. At all events, it is always the water contained in the canister which is radiolysed, except when resin is used when it is this same resin which undergoes radiolysis.

DISCLOSURE OF THE INVENTION

The objective of the invention is therefore to overcome the above-mentioned disadvantages at least in part, which relate to prior art solutions.

For this purpose, the first subject of the invention is a packaging device for the transport and/or storage of a radioactive medium generating flammable gases and/or explosives via radiolysis, the said device comprising at least one canister intended to contain the radioactive medium, the said canister defining an inner storage space accessible via an opening through which the medium is filled, on which plug-forming means are mounted.

According to the invention, the said device also comprises a chamber-forming structure, and means for placing in communication allowing a first fluid communication to be set up between the said inner storage space and the said chamber.

Therefore, the flammable gases and/or explosives produced by radiolysis during storage and/or transport of the radioactive medium are able to pervade not only the non-filled part of the inner storage space of the canister, called the gaseous headspace, but also the volume of the chamber through the presence of the said first fluid communication. Since the gases generated by radiolysis are able to be diluted in a larger volume than the mere volume of the gaseous headspace alone, each canister on this account can contain a greater quantity of radioactive medium without the risk of reaching the flammability threshold of these gases. This increase in the filling level of the canisters involves major economic savings since, for a given quantity of medium, it reduces the number of transport operations required.

In addition, the invention also allows the transport/storage time to be increased without the risk of reaching the flammability threshold of the gases generated by radiolysis, again on account of the fact that the gases are able to be diluted within a larger volume.

Also, each canister may continue to be of restricted size, facilitating easier handling thereof, in particular for filling operations of the medium into the inner storage space which are usually conducted in a glove box. It is only after filling and placing the plugging means in position that the inner storage space and the chamber are placed in fluid communication. In this respect, it is noted that if provision is made so that each canister is preferably arranged outside the chamber, preferably being removably mounted on the structure, it is also possible to make provision so that each canister is housed inside the chamber with which its inner storage space communicates. In addition, for cases when the canisters are arranged outside the chamber, they may alternatively be positioned at a distance away from the chamber-forming structure, without being mechanically mounted thereupon.

The invention applies to the packaging of liquid radioactive media, but also to the packaging of all other radioactive media liable to generate flammable gases and/or explosives via radiolysis.

According to a first preferred embodiment of the present invention:

the canister additionally comprises a first orifice opening into the inner storage space, the said chamber-forming structure comprises a second orifice opening into the said chamber, and the said first and second orifices form the two opposite ends of the said first fluid communication.

This first embodiment corresponds to the case when the canister is designed to be arranged outside the chamber, preferably being removably mounted on the structure. The said first fluid communication may integrate any element between the first and second orifices, in particular controllable means allowing these first and second orifices alternately to be released/closed.

In this respect, the said means for placing in communication preferably comprise a first member mobile between an open position in which it sets up the said first fluid communication, and a closed position in which it shuts the said second orifice, the said first mobile member being mounted on the said chamber-forming structure.

This first mobile member may indifferently form an actuating member intended to set up the first fluid communication, or it may form a follower member of this actuating member. In both cases, the actuating member can be driven manually by an operator or it can be set in movement in automated manner in response to a signal activated by an operator.

According to a second preferred embodiment of the present invention:

the canister further comprises a third orifice opening into the inner storage space, the said chamber-forming structure comprises a fourth orifice opening into the said chamber, and the said means for placing in communication allow a second fluid communication to be set up between the said inner storage space and the said chamber, the said third and fourth orifices forming the two opposite ends of the said second fluid communication.

With this second embodiment, largely similar to the first, the flammable gases and/or explosives produced by radiolysis during transport and/or storage of the radioactive medium are able to pervade the volume of the chamber by passing through both the said first fluid communication and the said second fluid communication. In addition, a number of fluid communications greater than two could be provided between the chamber and the inner storage space of the canister, without departing from the scope of the invention.

According to a third preferred embodiment of the present invention:

the canister further comprises a third orifice opening into the inner storage space, the said chamber-forming structure comprises a fourth orifice opening into the said chamber, the said means for placing in communication allow a second fluid communication to be set up between the said inner storage space and the said chamber, the said third and fourth orifices forming the two opposite ends of the said second fluid communication, and a fifth and a sixth orifice are provided in the chamber-forming structure, and communicate with each other via a connecting duct forming an integral part of the said means for placing in communication.

This third preferred embodiment is specially adapted so that it is possible to achieve inerting of the different components of the packaging device. Preferably, the said means for placing in communication comprise a first mobile member and a second mobile member, each mounted on the said chamber-forming structure and able to be moved between an open position and a closed position, the said first mobile member being designed so that:

in open position, firstly it places in communication the said first orifice with the said fifth orifice, and secondly it sets up the said second fluid communication by placing the said third orifice in communication with the said fourth orifice;

in closed position, firstly it ensures the placing in communication of the fourth orifice with the said fifth orifice, and secondly it prohibits the communication of each of the fourth and fifth orifices with the outside of the said chamber, and in that the said second mobile member is designed so that:

in open position, firstly it places the said sixth orifice in communication with the outside of the said chamber, and secondly it places the said second orifice in communication with the outside of the said chamber;

in closed position, firstly it ensures the placing in communication of the sixth orifice with the said second orifice, and secondly it prohibits the communication of each of the second and sixth orifices with the outside of the said chamber.

Therefore, by adopting adequate combining of the positions of the two mobile members, it is alternately possible to achieve inerting of the canister and the chamber, inerting of the chamber alone, to set up the first/second fluid communication, and to place the chamber in closed circuit.

Here too the first mobile member may indifferently form an actuating member intended to set up the first fluid communication, or it may form a follower member of this actuating member. In both cases, this actuating member may be driven manually by an operator, or it can be set in movement in automated manner in response to a signal activated by an operator.

In this respect, irrespective of the envisaged embodiment, the said canister preferably comprises an additional first mobile member, mobile between an open position in which it sets up the said first fluid communication, and a closed position in which it shuts the said first orifice, either one of the first mobile member and additional first mobile member being an actuating member and the other a follower member of the actuating member, so that the movement of the actuating member from its closed position to its open position leads the said follower member also to move from its closed position to its open position, and conversely.

In other words, the first mobile member is dedicated to closing/releasing the second orifice opening into the chamber, whilst the additional first mobile member is dedicated to closing/releasing the first orifice opening into the inner storage space of the canister, either one of these members possibly forming an actuating member, preferably able to be manually actuated by an operator, and leading the other of these two members.

Preferably, the said actuating member also forms a mechanical connection member of the said canister on the chamber-forming structure, this mechanical connecting function therefore being additional to the function of setting up/breaking the first fluid communication.

Preferably, the actuating member is designed so that the movement thereof from its closed position to its open position, with the said canister bearing upon this first mobile member, ensures mechanical connection of the canister, and such that the movement from its open position to its closed position ensures the mechanical disconnection of this canister. As a result, a single action on this actuating member simultaneously allows the generation of effects on the mechanical connection and effects on the fluid communication.

Preferably, the said actuating member forms a male or female bayonet mechanical connection.

Preferably, the device comprises a plurality of canisters each associated with means for placing in communication allowing a first fluid communication between its inner space and the said chamber. On this account, several canisters share the same chamber, entailing optimisation of the device in terms of weight and volume.

Preferably, in the third preferred embodiment, the means for placing in communication of all the canisters share the same second orifice, and the said second mobile member is designed so that:

in open position, firstly it places in communication each of the sixth orifices with the outside of the said chamber, and secondly it places the said single second orifice in communication with the outside of the said chamber; and in closed position, firstly it ensures the placing in communication of each of the sixth orifices with the said single second orifice, and secondly it prohibits the communication of the single second orifice and each of the sixth orifices with the outside of the said chamber.

As a result, the sole actuating of the second mobile member allows an effect to be had on all the canisters simultaneously, giving rise to simplification of the controls.

The invention also relates to an assembly comprising the said packaging device in any of the above-described forms. In this assembly, each canister houses in its inner storage space a given volume of radioactive medium, defining a level forming a horizontal boundary with a gaseous headspace completing this inner storage space, the said means for placing in communication associated with the said canister having a first orifice opening into the said inner storage space and arranged such that, at all times, it is in communication with the gaseous headspace, irrespective of the spatial orientation of the said canister integrating the said given volume of medium. Here, the invention applies more particularly to liquid radioactive media, and more generally to any medium whose consistency allows a level to be defined forming the horizontal boundary with the gaseous headspace.

In other words, irrespective of the spatial position of the canister, at least one part of the through end of the first orifice is not bathed in the medium so that it is possible at all times to allow the gases produced by radiolysis to escape in the direction of the chamber.

Therefore, in the event of accidental conditions in which the device no longer lies in normal transport/storage position, namely vertically, the fluid communication between the gaseous headspace of the canister and the chamber is maintained. This avoids risks of sudden exceeding of the flammability threshold of the gases in the gaseous headspace of the canister.

Preferably, this first orifice is provided at least in part with a duct projecting inwardly inside the said inner storage space. In addition, it preferably opens in the vicinity of a baric centre of the said inner storage space.

A further subject of the invention is a package for the transport and/or storage of a radioactive medium, comprising an overpack forming a cavity inside which a said assembly such as above-described is housed.

The invention also relates to a container for transporting and/or storing a radioactive medium, comprising an overpack forming a cavity inside which a packaging device such as described above is housed. This container differs from the package previously mentioned by the fact that the packaging device is empty i.e. it does not contain the radioactive medium.

Finally, the invention also concerns a method for packaging a radioactive medium in a packaging device for the transport and/or storage of a radioactive medium in which:

the radioactive medium is loaded into the inner storage space of the canister;

the canister is sealed using plug-forming means, and the said first fluid communication is set up between the said inner storage space and the said chamber.

Other advantages and characteristics of the invention will become apparent from the detailed, non-limiting description given below.

BRIEF DESCRIPTION OF THE DRAWINGS

This description will be made in connection with the appended drawings among which:

FIG. 1*b*' is a cross-sectional view taken along line Ib'-Ib' in FIG. 1*b;*

FIG. 3*c*' is a cross-sectional view taken along the line IIIc'-IIIc' in FIG. 3*c;*

DETAILED DESCRIPTION OF PREFERRED EMBODIMENTS

Figure 1:
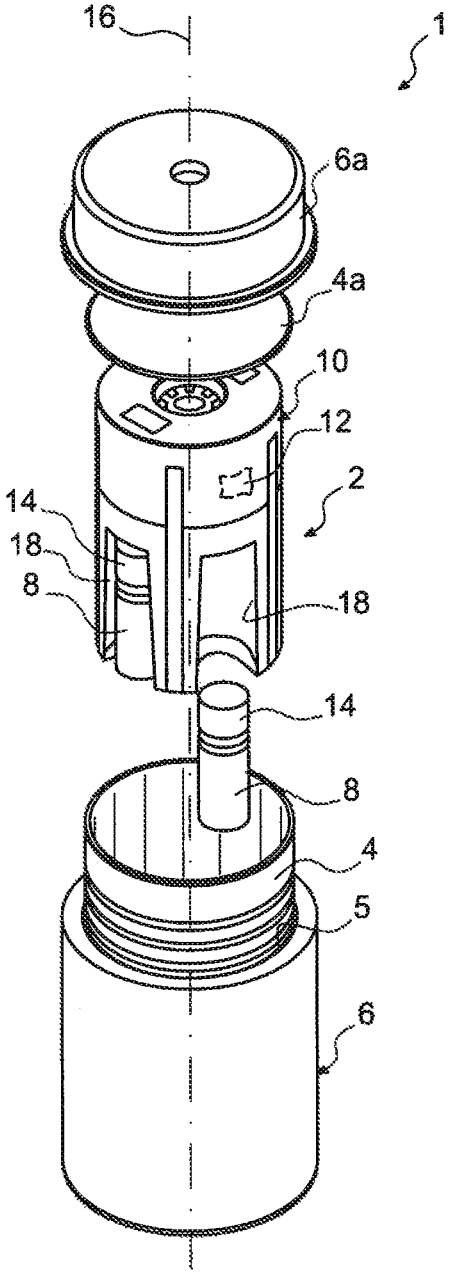
FIG. 1 is a perspective, partly exploded view of a package for the transport and/or storage of a radioactive medium according to a first preferred embodiment of the invention.

First, with reference to FIG. 1, a package for transport and/or storage of a radioactive medium can be seen, according to a first preferred embodiment of the invention. This radioactive medium is preferably a liquid in which the radioactive material is in ionic form and/or in the form of solid particles dispersed in the liquid.

The package 1 comprises a packaging device 2 for the transport and/or storage of the radioactive medium, this device also being the subject of the present invention.

As is schematically illustrated in FIG. 1, the packaging device 2, optionally covered with a vinyl sleeve (not illustrated) is housed in a cask 4 closed by a lid 4*a*. The cask 4 is then itself housed in the cavity 5 of an overpack 6, closed by a lid 6*a*, to form the package 1.

The packaging device 2 has the particularity of comprising a plurality of canisters 8 and a structure 10 forming a chamber 12. Each canister 8 defines an inner storage space in which the radioactive medium is placed, this spaced being closed by plug-forming means 14, via which the canister is mechanically and removably connected to the structure 10.

In this respect, the structure 10 assumes a general cylindrical shape of axis 16 and of circular cross-section, which has cut-outs 18 distributed circumferentially to house the canisters 8. As can be seen in FIG. 1, each cut-out 18 which can be likened to an imprint, opens radially outwards and axially downwards, having slightly larger dimensions than the canister 8 which it receives. The canisters 8 arranged parallel and around the axis 16 may be inserted in their respective cut-outs via axial and/or radial movement.

Therefore, five canisters for example can be installed on the structure 10 outside the chamber 12, in the cut-outs 18 provided in identical number.

Figure 1A:
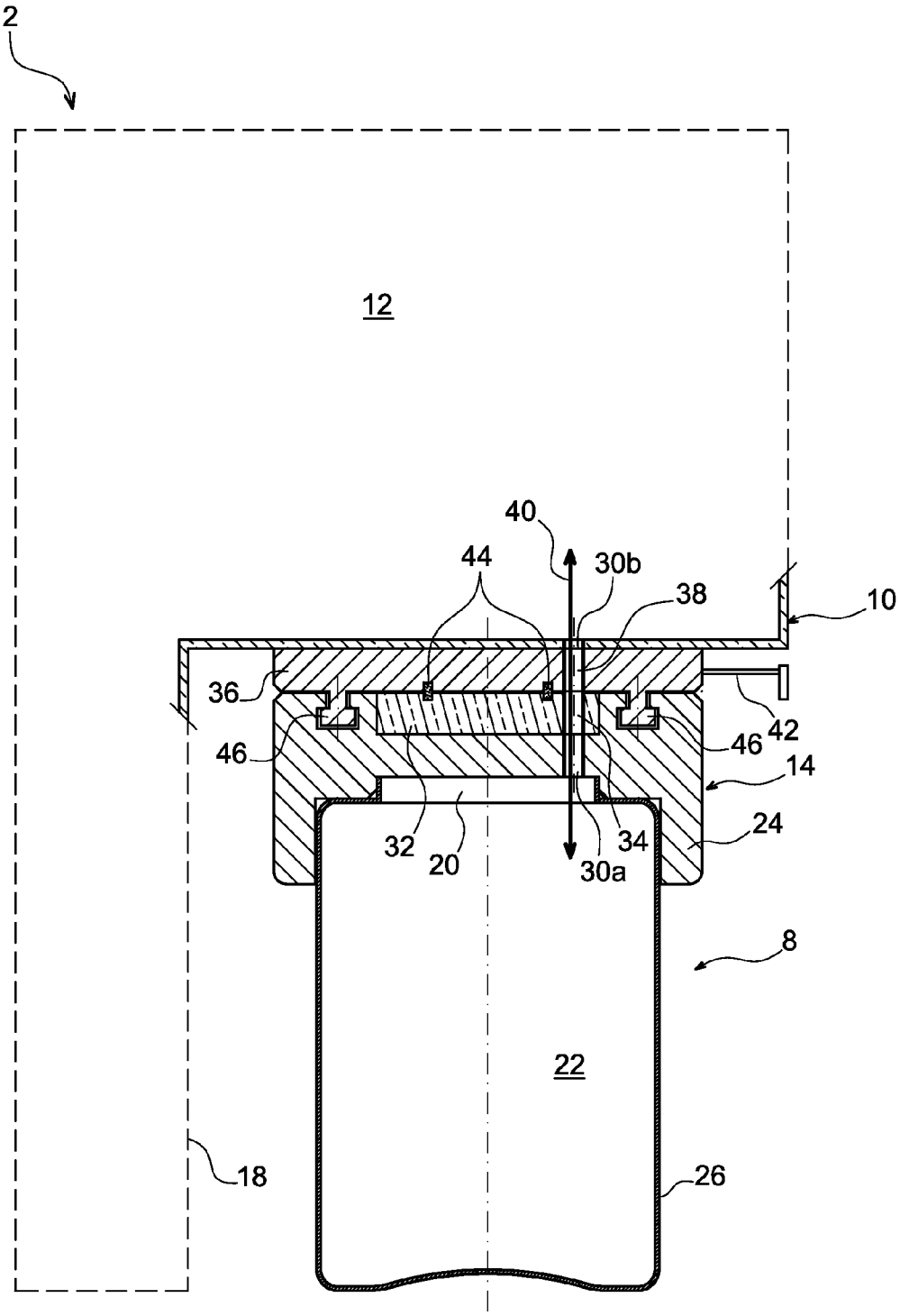
FIG. 1*a* is a partial, cross-sectional view showing one of the canisters mounted on the chamber-forming structure, with the first mobile member in open position setting up fluid communication between this chamber and the canister.

With reference now to FIG. 1*a*, one of the canisters 8 can be seen mounted removably on the structure 10 forming a chamber 12, by means of its plug-forming means 14. These means 14 shut off a filling opening 20 provided in the upper part of the inner storage space 22 of the canister 8, this opening 20 allowing the prior filling of the radioactive medium (not illustrated) in the space 22, conducted in a glove box. Here, the diameter of the opening 20 is substantially identical to the mean diameter of the canister, and is also of general cylindrical shape with circular cross-section. The canister may nevertheless assume any other shape such as a case or box, preferably in metal.

The plug-forming means 14 comprise a first shutoff part 24 for example screwed onto the upper end of the side body 26 of the canister, a part through which a first through orifice 30*a* is provided which opens into the inner storage space 22. It is this part 24 which covers the opening 20 defined by the side body 26. The means 14 further comprise a second shutoff part 32 for example mounted in rotation on the first shutoff part 24, and whose essential function is to shut/release the first through orifice 30*a*. To do so, the part 32 also comprises a through passage 34 which can be aligned or off-centred from the first orifice 30*a*, in relation to the relative angular position between the two shutoff parts 24, 32.

The structure 10, in the form of a wall delimiting the chamber 12, integrates a second through orifice 30*b*, which opens into the chamber 12. This second orifice 30*b* is provided in the part of the structure 10 which defines the upper end of the imprint 18, opposite the plug-forming means 14 of the canister. A first mobile member 36 is mounted outwardly on the structure 10 directly above the second orifice 30*b*, so that it is possible in particular to ensure the shutting/release of this orifice 30*b*.

For this purpose, the mobile member 36 also comprises a through passage 38 able to aligned with or off-centred from the second orifice 30*b*, in relation to the relative angular position between the mobile member 36 and the structure 10.

In the configuration illustrated in FIG. 1*a*, the canister 8 is not only mechanically mounted on the structure 10 in a manner described below, but a first fluid communication 40 is also set up between the space 22 and the chamber 12. This communication 40 is initiated by the first orifice 30*a*, is extended by the passages 34 and 38 lying in the continuity of each other, and then ends in the second orifice 30*b*. Therefore, any gas located in the space 22 is able to transit in sealed manner towards the chamber 12 via the first fluid communication 40 forming a channel, and conversely. This of particular importance since the flammable gases and/or explosives, produced by radiolysis during storage and/or transport, are able to move into the inner storage space 22, and also into the volume of the chamber 12.

Here, the mobile member 36 also fulfils the function of actuating member, able to be driven by an operator, for example using a handle or lever 42. By causing this member 36 to pivot, the operator is effectively able to move it from its open position shown in FIG. 1*a* in which it sets up the first fluid communication 40, to a closed position shown in FIGS. 1*b* and 1*b*', in which it shuts the second orifice 30*b*, which leads to breaking the communication 40.

When the canister 8 is mounted on the structure 10, lying flat against the mobile actuating member 36, this member is coupled in rotation with the second shutoff part 32, for example by means of pins 44 arranged on the interface, carried by either one of the members 32, 36. Therefore, during the movement of the mobile actuating member 36 from its open position to its closed position, this member 36 drives with it and in rotation the shutoff part 32. This latter part 32 thus moves simultaneously from its open position shown in FIG. 1*a* in which it sets up the first fluid communication 40, to its closed position shown in FIG. 1*b* in which it shuts off the first orifice 30*a*, which also leads to breaking the communication 40. Owing to the driving in rotation to which it is subject, the shutoff part 32 forming an additional mobile member is termed a follower member.

It is noted that sealing means (not illustrated) of sealing gasket type are preferably provided so that the closed position of the additional follower mobile member 32 ensures the sealed closing of the inner storage space 22, and so that the closed position of the mobile actuating member 36 ensures the sealed closing of the chamber 12.

To change from the closed position of the members 32, 36 to the open position, the actuating member 36 is driven manually in reverse direction to the closing direction. In this respect, the design of the packaging device 2 is such that the actuating member 36 also forms a mechanical connection member of the canister 8 on the structure 10.

Figure 1B:
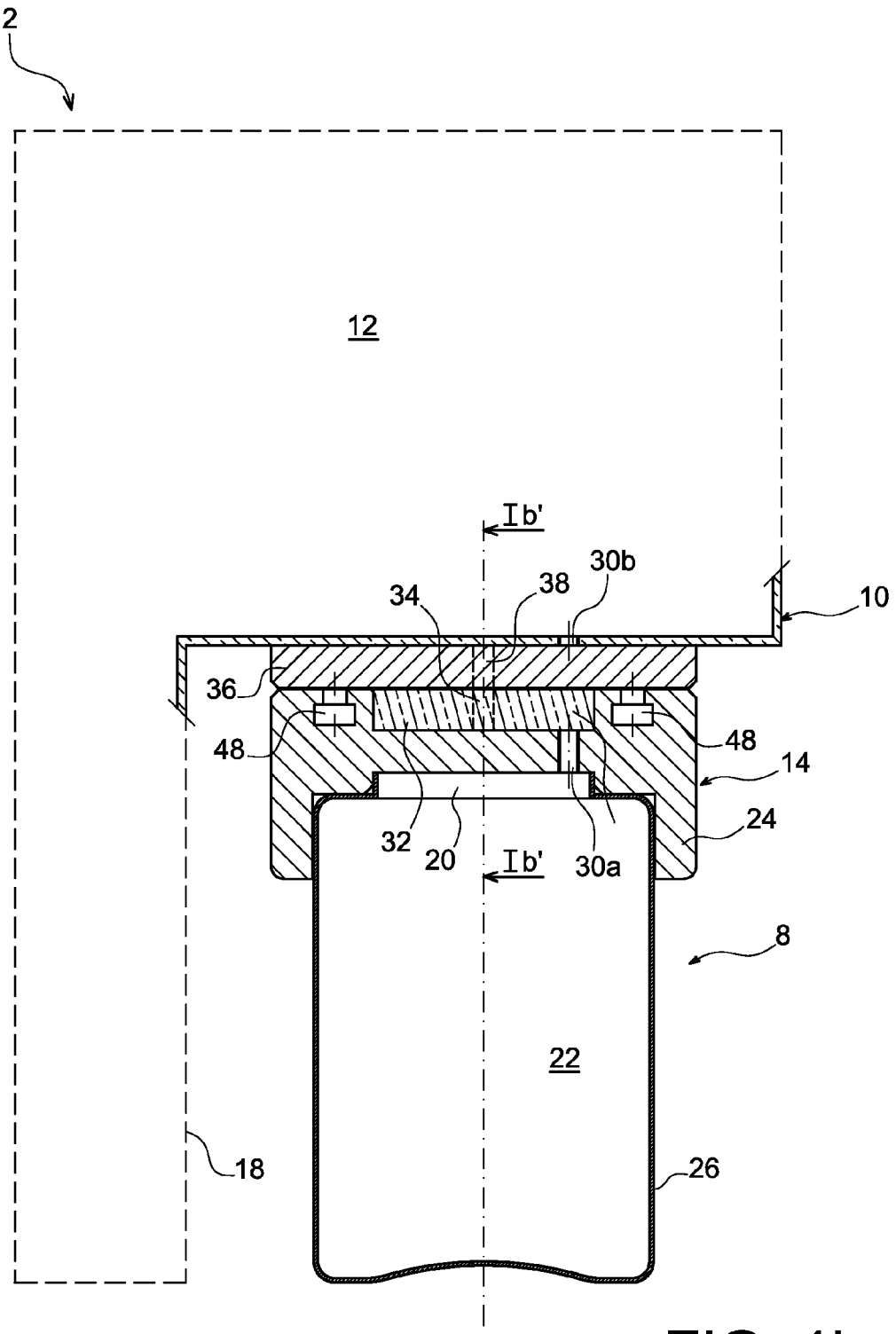
FIG. 1*b* is a similar view to the view in FIG. 1*a*, with the first mobile member in closed position prohibiting fluid communication between the chamber and the canister.
Figure 1B:
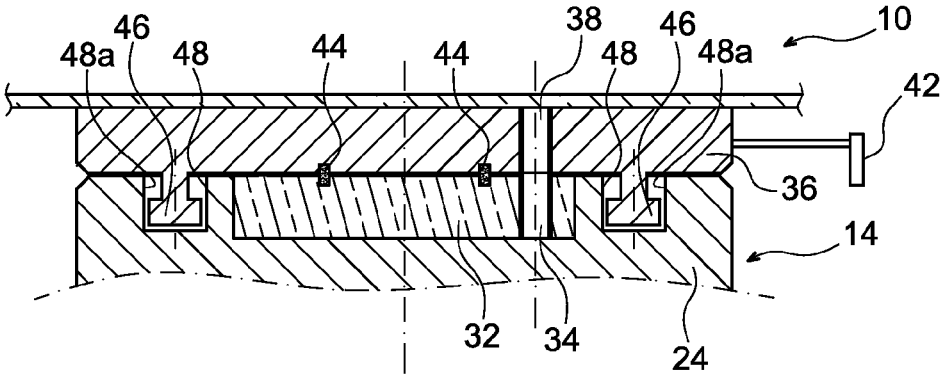
Figure 1C:
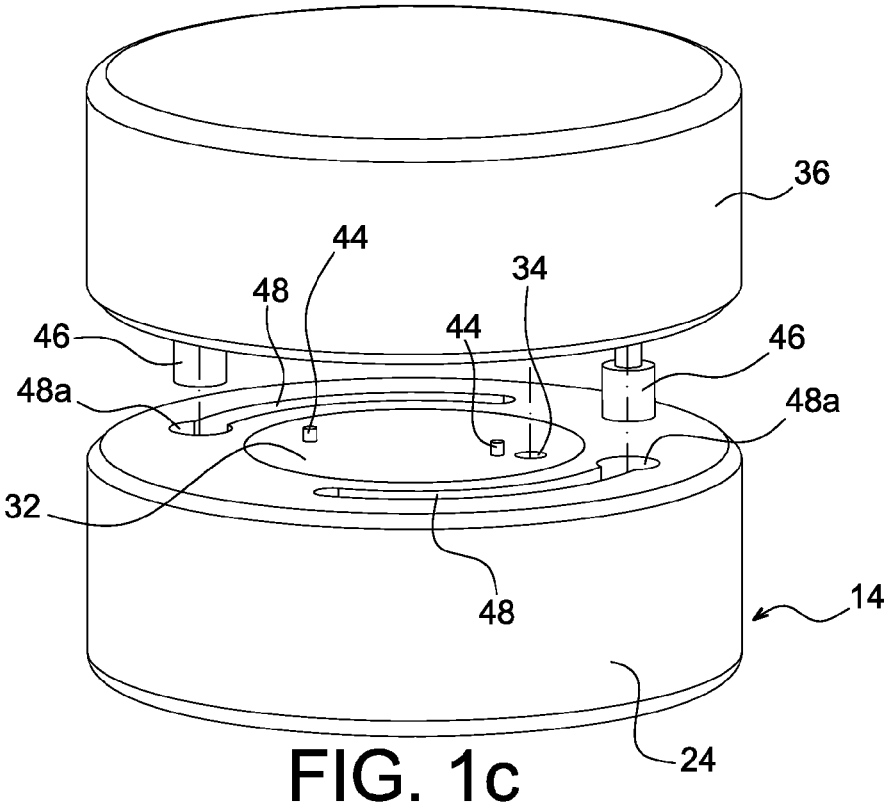
FIG. 1*c* is a schematic perspective view showing the bayonet mechanical connection mechanism provided for mounting the canister on the chamber-forming structure.

Here, the actuating member 36 forms a male part of a bayonet mechanical connection, having for example two pins 46 of inverted-T cross-section projecting downwardly as shown in FIGS. 1*a*, 1*b*' and 1*c*. The female part of the mechanical bayonet connection is then formed by the first shutoff part 24 of the plug-forming means 14 by means of grooves 48 open on the upper surface of this part, and each having a widened end 48*a* which can be seen in FIGS. 1*b*' and 1*c*. Outside this widened end 48*a*, the shape of each groove 48 mates with the shape of its associated pin 48, namely with a cross-section of inverted T-shape opened upwardly.

Therefore, to ensure the desired mechanical connection between the canister 8 and the structure 10, the canister is inserted in its cut-out 18 so that its first shutoff part 24 lies flat against the mobile actuating member 36, with the inverted heads of the Ts 46 housed in their respective widened ends 48*a* of the grooves 48. Then, when the member 36 is moved by the operator from its closed position to its open position, for example corresponding to a quarter turn, the inverted heads of the Ts 46 move along the grooves 48 in which they are retained by means of their narrowed openings relative to the respective ends 48*a*. In open position of the mobile member 36, illustrated in FIG. 1*a*, each inverted head 46 then lies in its groove 48 at the opposite end to the widened end 48*a*, entailing mechanical connection of the canister 8 on the structure 10.

Next, when the canister 8 must be mechanically disconnected from the structure 10, the mobile member is again moved by the operator to its closed position illustrated in FIG. 1*b*', again by performing a quarter turn, the effect of which is to return the inverted heads of the Ts 46 to their respective widened ends 48*a*. The canister 8, mechanically disconnected from the structure 10, then only needs to be displaced axially and downwardly so that it can be extracted from the packaging device 2.

Evidently, this principle of mechanical connection/disconnection and breaking/setting-up of the first fluid communication is applied for each of the canisters equipping the packaging device. In this respect, the device can be used with only some of the cut-outs 18 respectively filled with canisters, the others remaining free, with the associated actuating member 36 placed in closed position so as sealingly to close the corresponding second orifice 30*b*. Alternatively, each cut-out 18 may house a canister, optionally covered with a vinyl sleeve, but with one or more of these canisters non-filled with radioactive medium. This allows an even further increase in the volume of the packaging device in which the flammable gases and/or explosives can be diluted, since the canisters communicate with each other via the chamber.

Figure 1D:
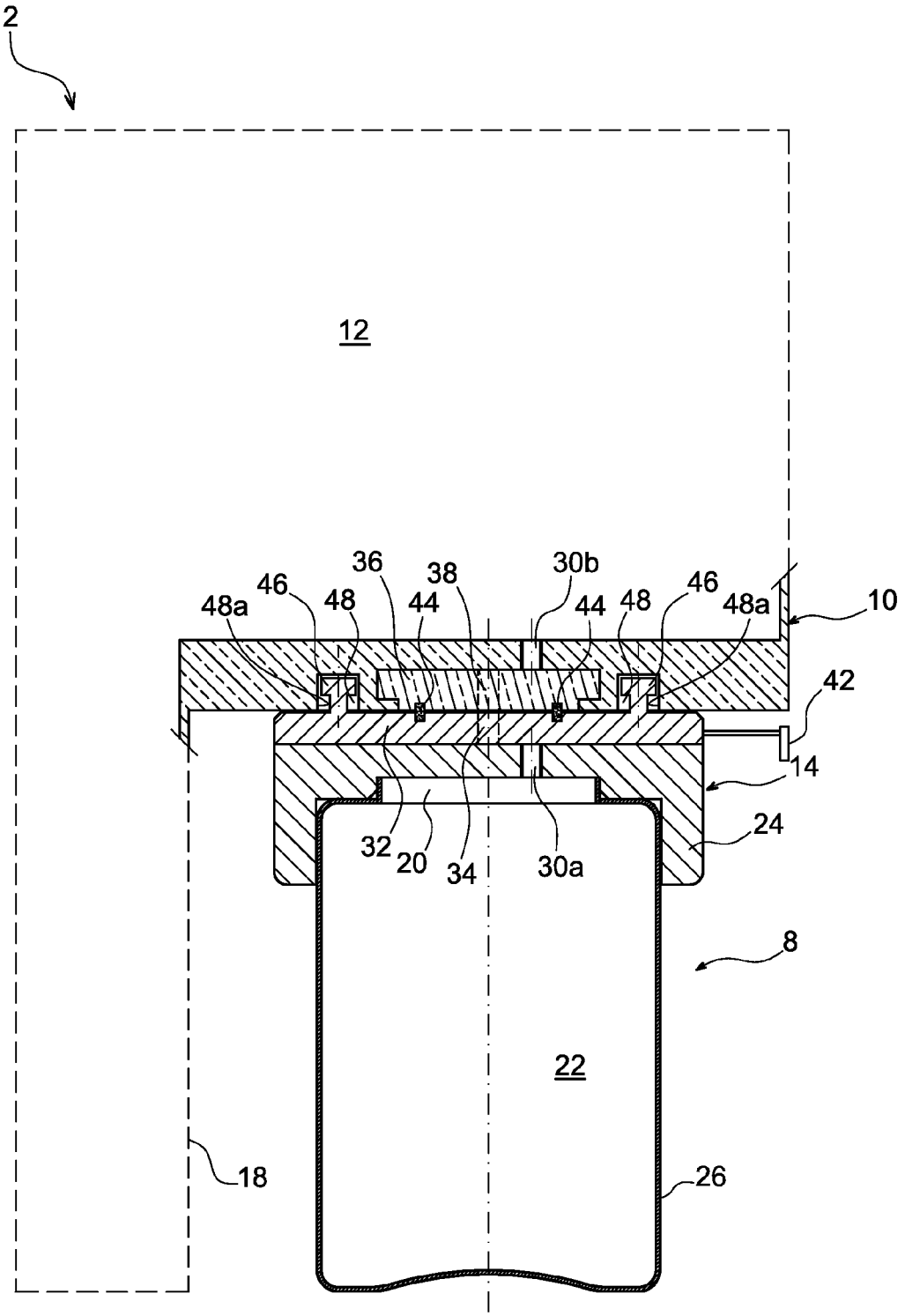
FIG. 1*d* is a similar view to the view in FIG. 1*b*, with the first mobile member shown in closed position, illustrated in the form of an alternative embodiment.

According to one alternative of the first embodiment shown in FIG. 1*d*, it is the second shutoff part 32 belonging to the plug-forming means 14 which fulfils the function of actuating member able to be driven by the operator by means of its lever 42, and the first mobile member 36 mounted outwardly on the structure 10 fulfils the role of follower member of the actuating member 32. Nonetheless, the functioning is similar to the functioning described above, in particular with the actuating member 32 also forming a mechanical connection member of the canister 8 on the structure 10. The actuating member 32 here also forms a male part of a bayonet mechanical connection, having two pins 46 for example of T-shaped cross-section projecting upwardly as shown in FIG. 1*d*. The female part of the bayonet mechanical connection is then formed by the structure 10, by means of grooves 48 opened downwardly, and each having a widened end 48*a*, as described above.

Figure 2A:
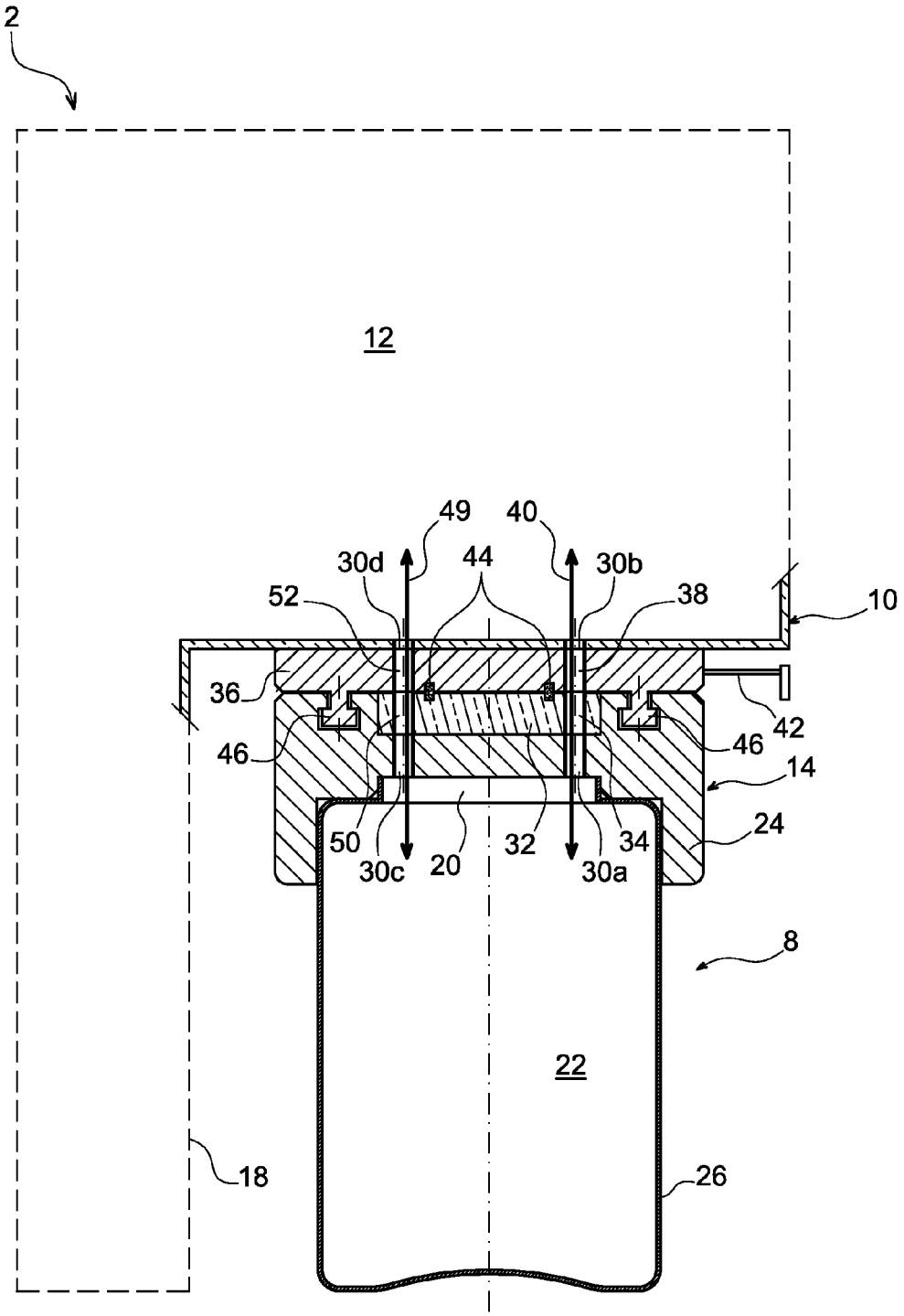
FIGS. 2*a* and 2*b* are similar views to those shown in FIGS. 1*a* and 1*b* respectively, with the packaging device in the form of a second preferred embodiment of the present invention.
Figure 2B:
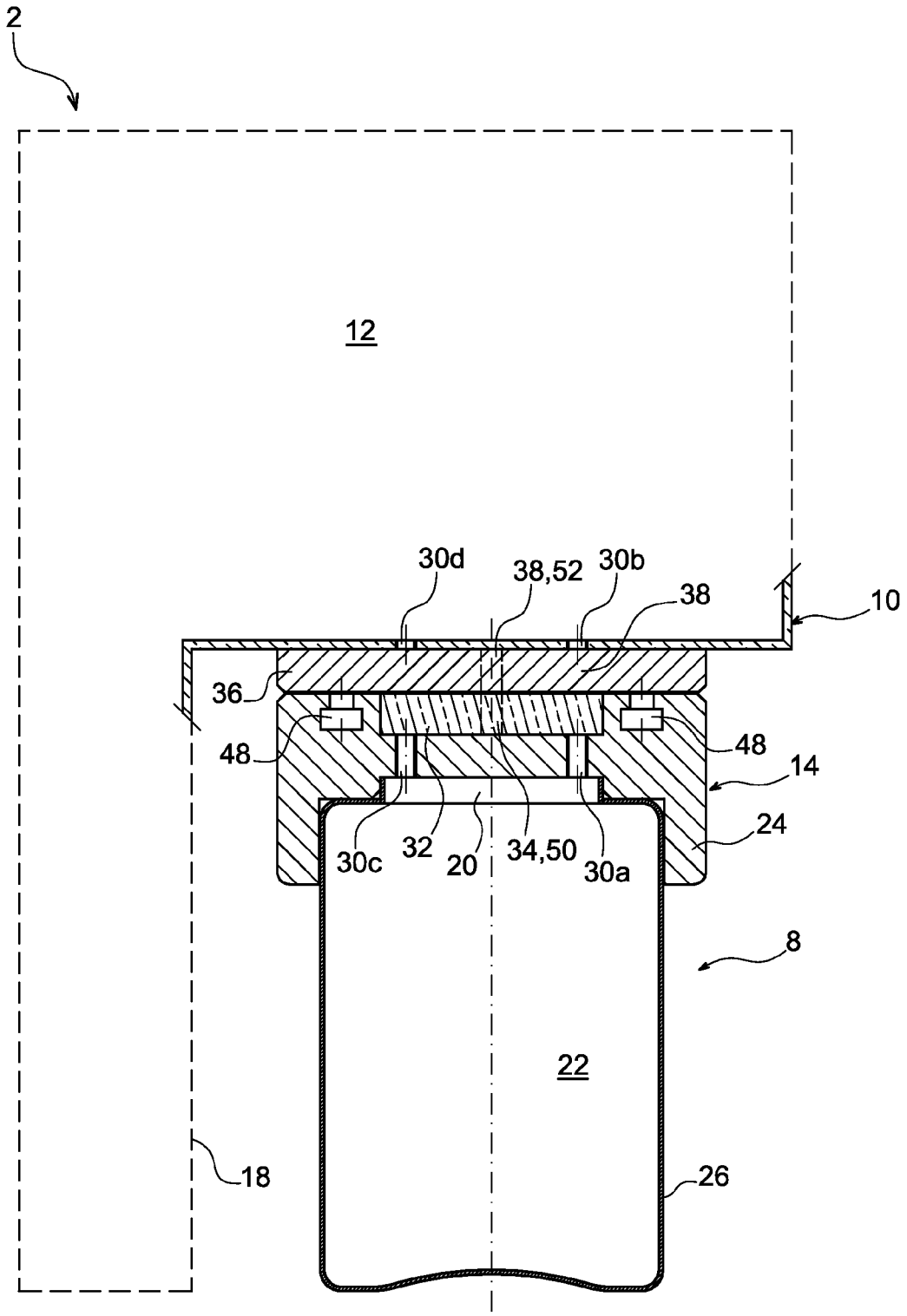

FIGS. 2*a* and 2*b* illustrate a packaging device 1 in the form of a second preferred embodiment of the present invention, similar to the first embodiment described above. In this respect, in the figures the parts carrying the same reference numbers designate identical or similar parts.

Therefore, it can be seen that this second embodiment reproduces all the characteristics of the first preferred embodiment, to which others have been added so that it is possible to set up/break a second fluid communication between the inner storage space 22 of the canister and the chamber 12 defined by the structure 10.

As can be seen in FIG. 2*a*, the second fluid communication 49 is initiated by a third orifice 30*c* opening into the inner storage space 22, is extended by passages 50 and 52 respectively provided on the second shutoff part 32 and the first mobile member 36, and ends in a fourth orifice 30*d* opening into the chamber 12.

In general, the second fluid communication 49 allows doubling of the communication already provided, and is based on the same design. In addition, the setting up of the first and second communications 40, 49 is obtained simultaneously by simple actuation of the first mobile member 36, and similarly the breaking of these first and second communications 40, 49 is simultaneously obtained also by actuating the first mobile member 36.

Figure 3A:
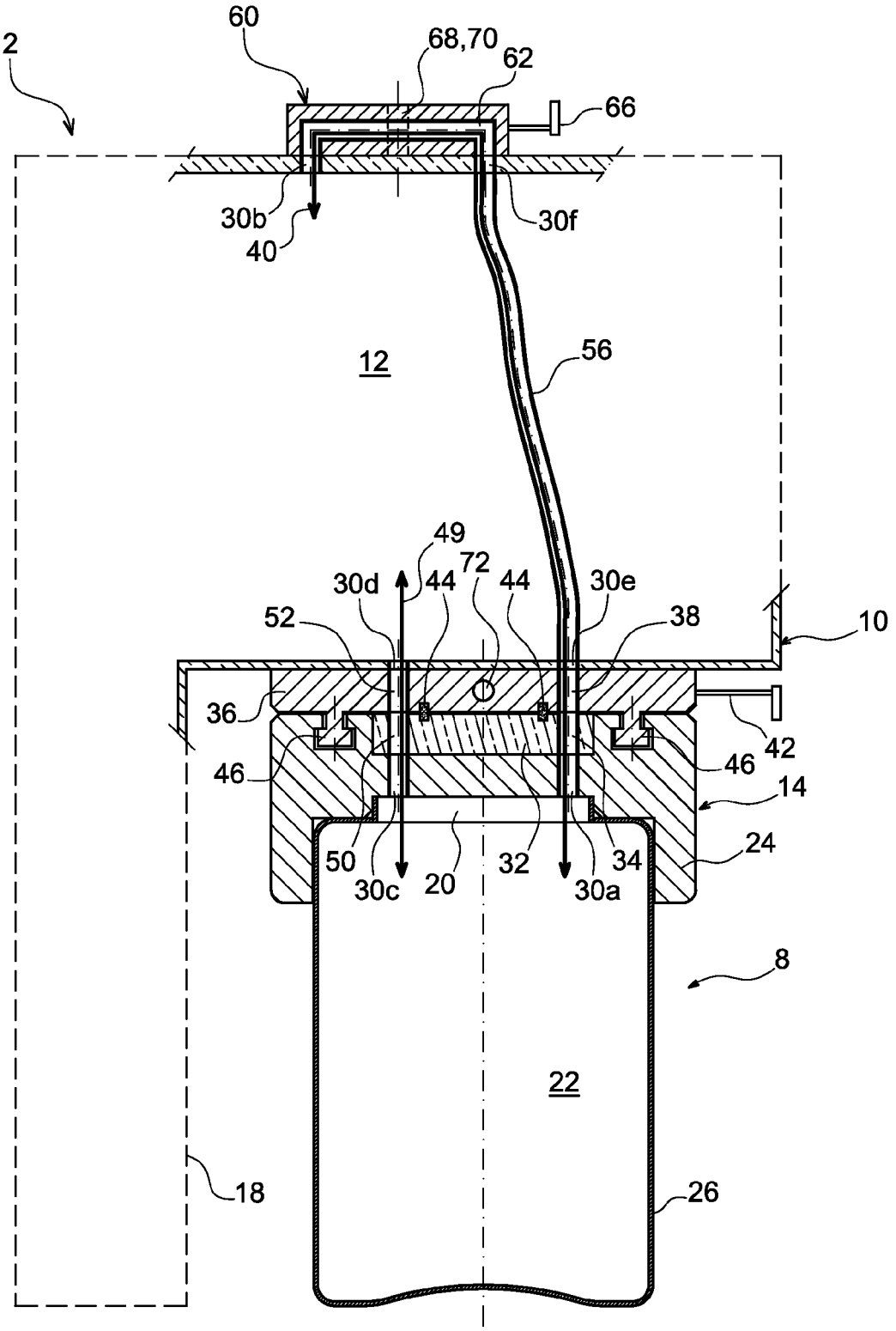
FIGS. 3*a* to 3*d* illustrate the packaging device according to a third preferred embodiment of the present invention, in different configurations of use.

With reference to FIG. 3*a*, a packaging device 1 can be seen, in the form of a third preferred embodiment of the present invention.

In this third embodiment, the second fluid communication 49, provided in the second embodiment, has been maintained.

On the other hand, the first fluid communication 40 is modified as follows. It is still initiated by the first orifice 30*a* of the first shutoff part 24 of the plug-forming means, and is then extended by the through passages 34 and 38 which lie in succession. It is then continued by a fifth orifice 30*e* opening into the chamber, precisely corresponding to the second orifice 30*b* of the preceding embodiments. The first fluid communication 40 is extended by a connecting duct 56 passing through the chamber 12 and which is therefore connected to the fifth orifice 30*e* at one of its ends, and connected at the other of its ends to a sixth orifice 30*f* provided in the structure 10 forming a wall of the chamber. As can be seen in FIG. 3*a*, this sixth orifice 30*f* preferably lies on an upper part of the structure 10. Then, a second mobile member 60, taking up a closed position such as the one illustrated in this figure, allows the sixth orifice 30*f* to be placed in communication with a second adjacent orifice 30*b* provided in the structure, and opening into the chamber 12. The first fluid communication 40 therefore finishes with the second orifice 30*b*.

Therefore, to obtain the two fluid communications 40, 49, the first mobile actuating member 36 must take up its open position described with reference to the preceding embodiments, whilst the second mobile member 60 must take up its closed position in which it ensures the placing in communication of the second and sixth orifices 30*b*, 30*f*, and on the other hand prohibits the communication of each of these orifices 30*b*, 30*f* with the outside of the chamber. To do so, the second mobile member 60 is mounted outwardly on the structure 10, directly above the orifices 30*b*, 30*f*, and comprises an inner U-shaped passage 62 connecting these two orifices 30*b*, 30*f* in sealed manner when it takes up its closed position.

The configuration show in FIG. 3*a* is adopted during the transport/storage of the radioactive medium present in the canisters. Therefore, the flammable gases and/or explosives generated by radiolysis in the inner storage space of the canisters are able to pass through the two fluid communications 40, 49, in order to reach the chamber 12 in which they can be diluted.

The second mobile member 60, mounted in rotation on the structure, can also be driven by an operator, for example by means of a handle or lever 66. By causing this member 60 to pivot, the operator is able to move it from its closed position shown in FIG. 3*a* in which it sets up the first fluid communication 40, to an open position shown in FIG. 3*b* in which it permits inerting of the canister 8 and of the chamber 12. In this open position, obtained for example by performing a quarter turn from the closed position, the second mobile member 60 allows the aligning of the two orifices 30*b*, 30*f* with two respective through passages 68, 70 provided therein, independently of the inner U-shaped passage 62 which becomes inactive, and therefore allowing each of the second and sixth orifices to be placed in communication with the outside of the chamber.

Figure 3B:
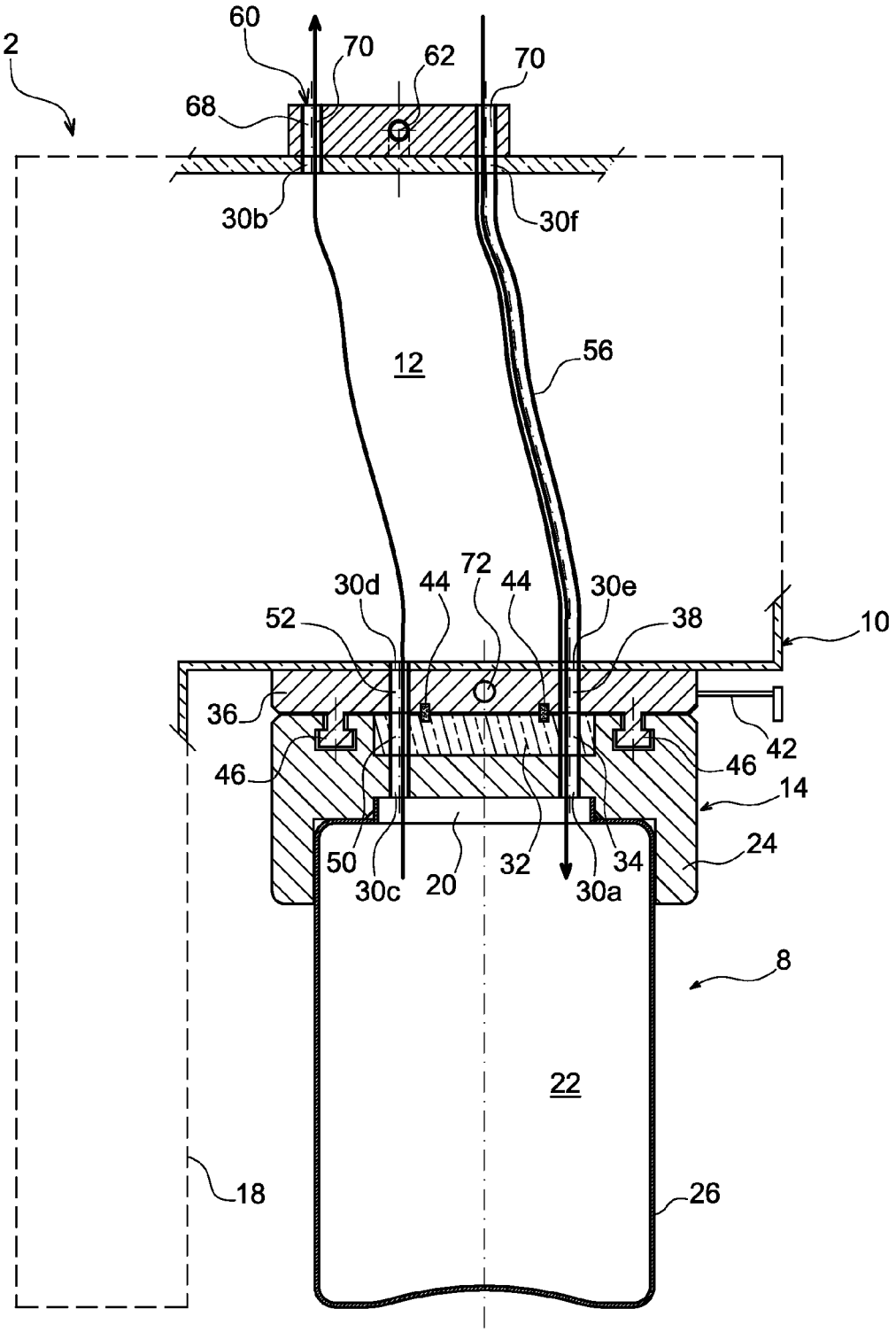

Therefore, in this configuration in FIG. 3*b*, it is possible to inject an inerting gas via the through passage 70 of the second mobile member 60, this gas then being led to inside the storage space 22 by passing through the sixth orifice 30*f*, the connecting duct 56, the fifth orifice 30*e*, the passages 38, 34, and the first orifice 30*a*. The inerting gas can then extract itself from the inner storage space via the second fluid communication to enter into the chamber 12, and extract itself therefrom via the second orifice 30*b* and the passage 68, and can finally be collected outside the chamber.

Figure 3C:
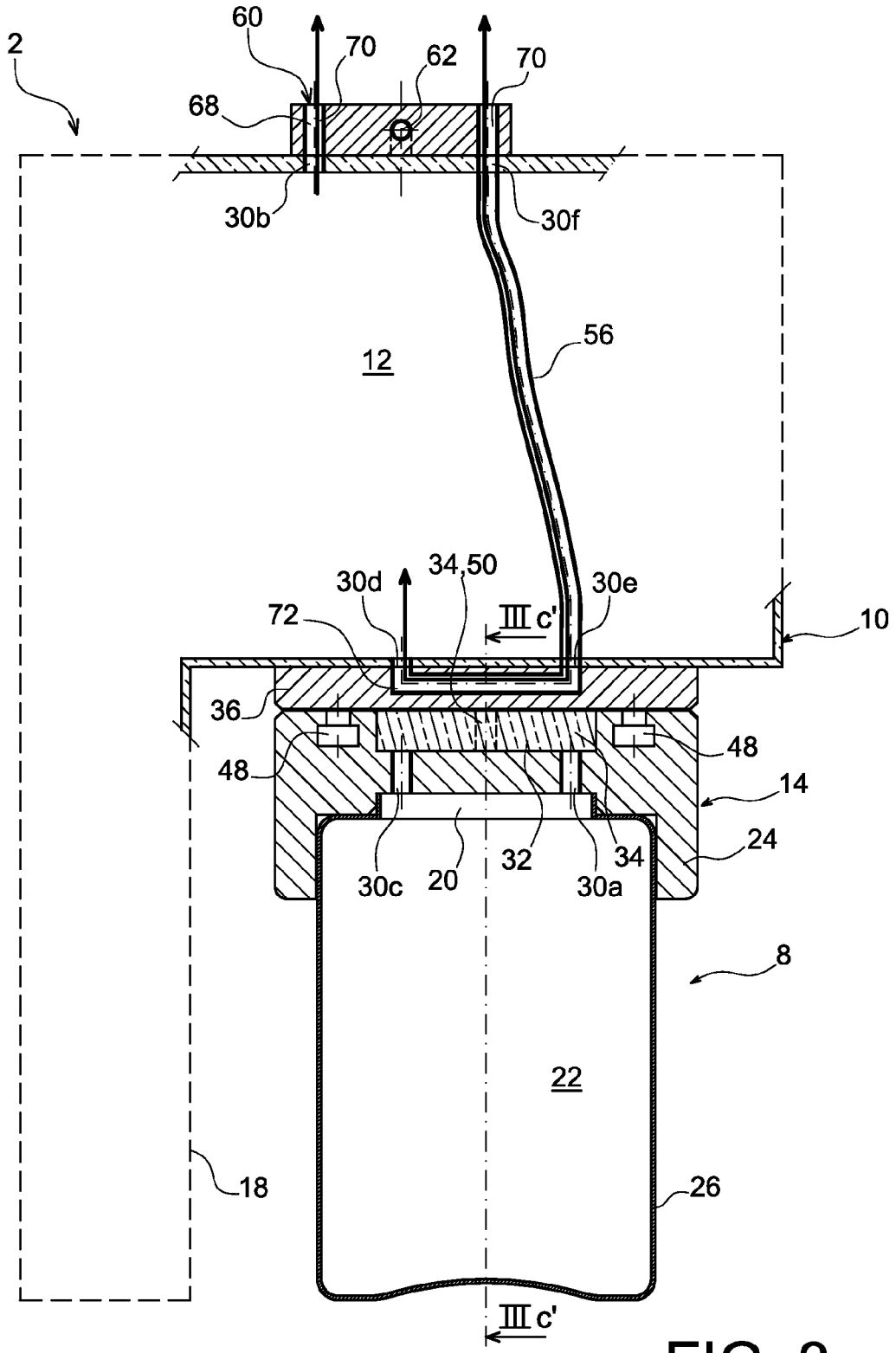
Figure 3C:
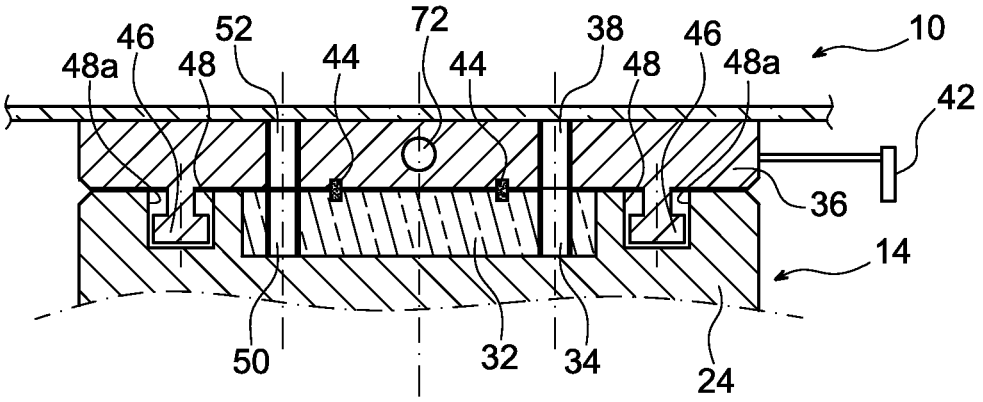

In this third preferred embodiment, the open position of the first mobile member 36 is identical to the position in the second preferred embodiment. On the other hand, when this mobile member 36 is moved by the operator to its closed position such as shown in FIGS. 3*c* and 3*c*', it does not come to block the two orifices 30*d*, 30*e* which it covers, but it ensures the placing in communication of these two orifices via an inner U-shaped passage 72 which it defines. It also prohibits the communication of each of these orifices 30*d*, 30*e* with the outside of the chamber, so that the two fluid communications are broken at this first mobile actuating member 36.

Figure 3D:
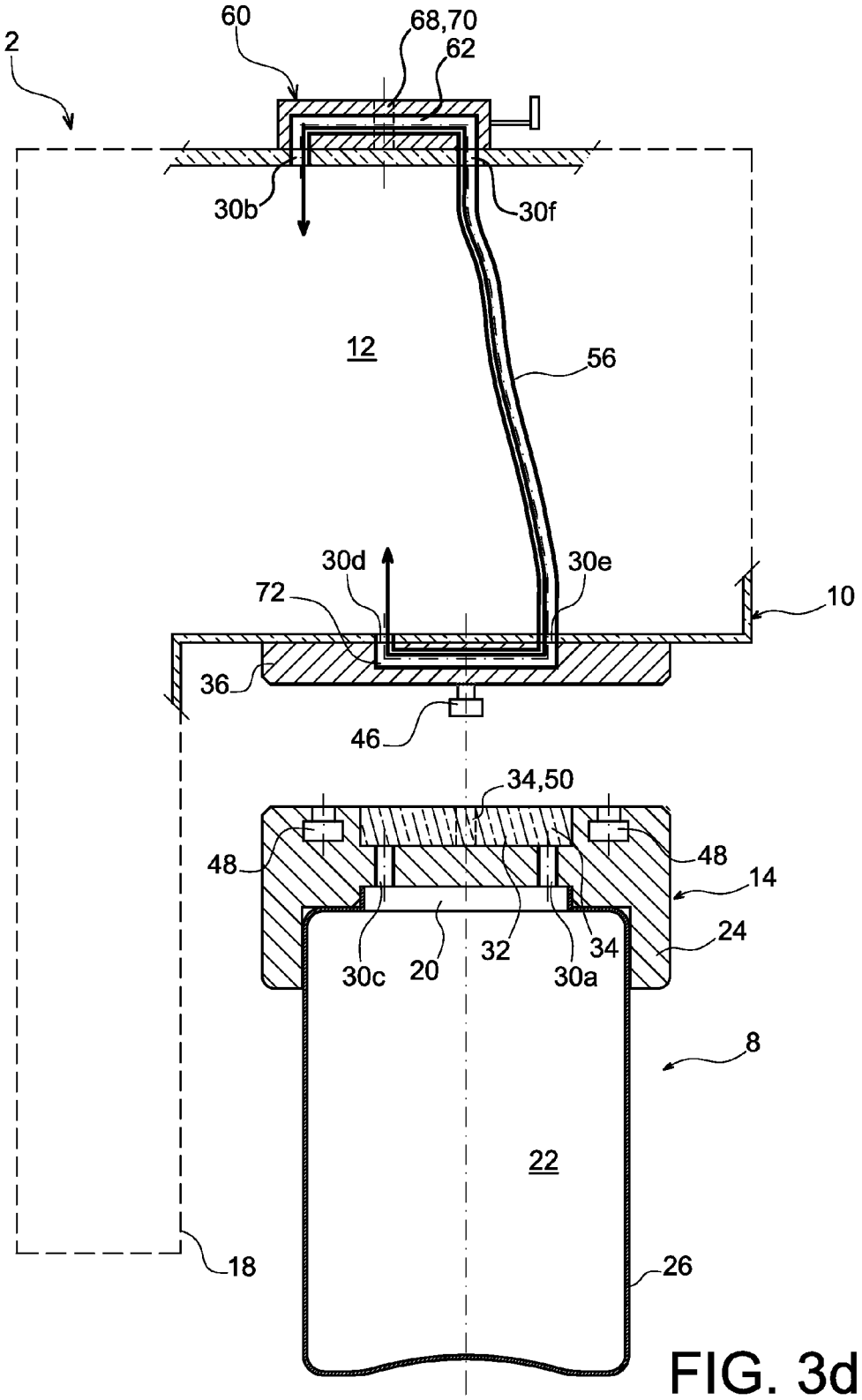

The chamber is therefore closed in sealed manner at the orifices 30*d*, 30*e* by the first mobile actuating member 36, which allows inerting of this chamber alone. It is effectively possible to inject an inerting gas via the through passage 70 of the second mobile member 60, this gas then passing through the sixth orifice 30*f*, the connecting duct 56, the fifth orifice 30*e*, the inner U-shaped passage 72 of the member 36, and the fourth orifice 30*d* from which it can enter the chamber. The inerting gas can then extract itself therefrom via the second orifice 30*b* and the passage 68, and can finally be collected outside the chamber. Evidently, in this configuration of FIGS. 3*c* and 3*c*' in which the first mobile member 36 is in closed position, the canister 8 is mechanically disconnected from the structure 10, and can therefore be removed from the packaging device, as is shown in FIG. 3*d*.

In this figure, the second mobile member 60 has been returned to closed position, so that the chamber 12 becomes sealingly closed at the orifices 30*b*, 30*f*, 30*d*, 30*e* of the structure 10.

It is possible to make provision for a second mobile member 60 to be allocated to each canister 8 of the packaging device. Nevertheless, for ease of handling and lesser volume, it is alternatively possible to make provision so that all the canisters 8 are associated with one same second mobile member 60, as is illustrated in FIGS. 3*e* and 3*f*.

Here, each canister is linked via its associated connecting duct 56 with a sixth orifice 30*f* which is particular thereto. On the other hand, only one single second orifice 30*b* is provided associated with all the canisters, the sixth orifices 30*f* being arranged for example around this second orifice 30*b*. In addition, the structure 10 integrates a fixed wall extension 80 placing in permanent communication all the sixth orifices 30*f* via an annular groove 82 into which the open.

Figure 3E:
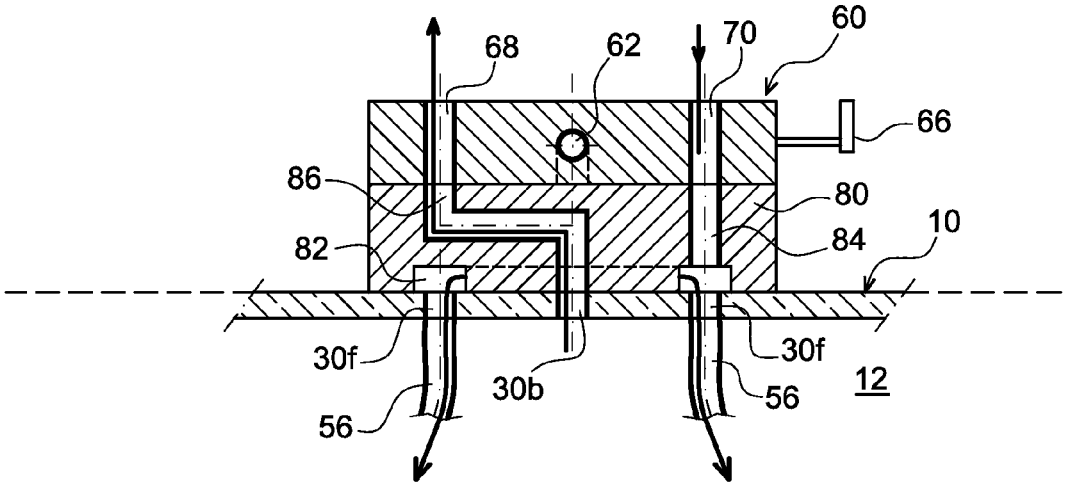
FIGS. 3*e* and 3*f* are cross-sectional views of the second mobile member, respectively shown in open and closed position, and in the form of an alternative embodiment.
Figure 3F:
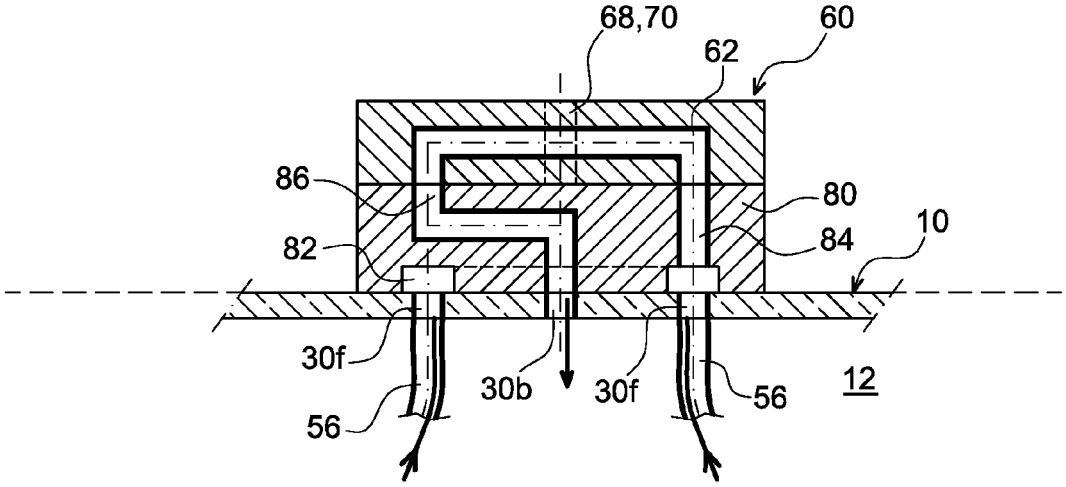

In open position of the second mobile member 60, shown in FIG. 3*e*, the sixth orifices 30*f* are in communication with the outside of the chamber by means of the aligning of the passage 70 of the member 60 with an outlet orifice 84 provided in the extension 80 and opening into the annular groove 82 forming a collector. Also, the passage 68 of the member 60 places the single second orifice 30*b* in communication with the outside of the chamber, via the aligning between the passage 68 and the extension 86 of the orifice 30*b* provided in the wall extension 80.

This configuration is indeed the configuration allowing inerting of the canisters and of the chamber.

On the other hand, in closed position of the second mobile member 60, shown in FIG. 3*f*, the inner U-shaped passage 62 ensures the placing in communication of each of the sixth orifices 30*f* with the single second orifice 30*b*, by connecting in sealed manner the extension 86 of orifice 30*b* with the outlet orifice 84 opening into the annular groove 82 associated with the sixth orifices 30*f*.

Also, the mobile member 60 prohibits the communication of the single second orifice 30*b* and each of the sixth orifices 30*f* with the outside of the chamber.

Figure 4A:
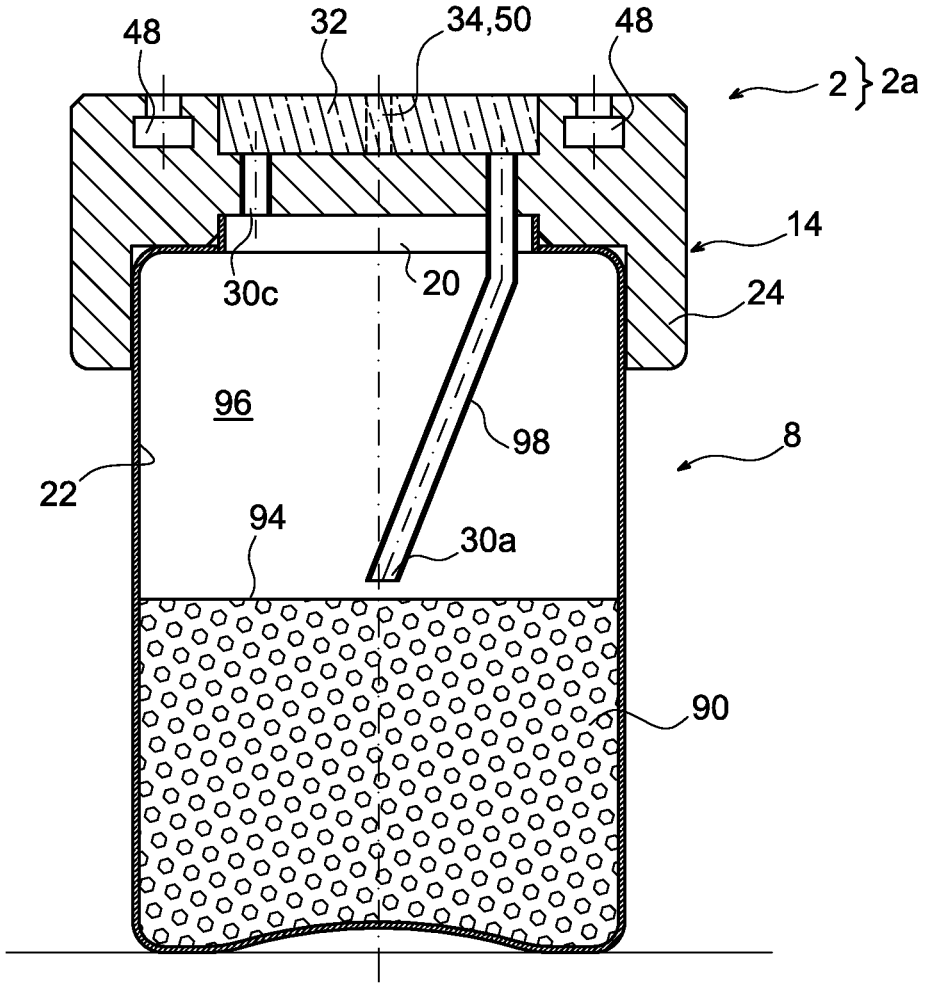
FIG. 4*a* shows another possible embodiment of the first orifice opening into the inner storage space of the canister, with this canister oriented in vertical position such as taken up under normal conditions of transport and/or storage.
Figure 4B:
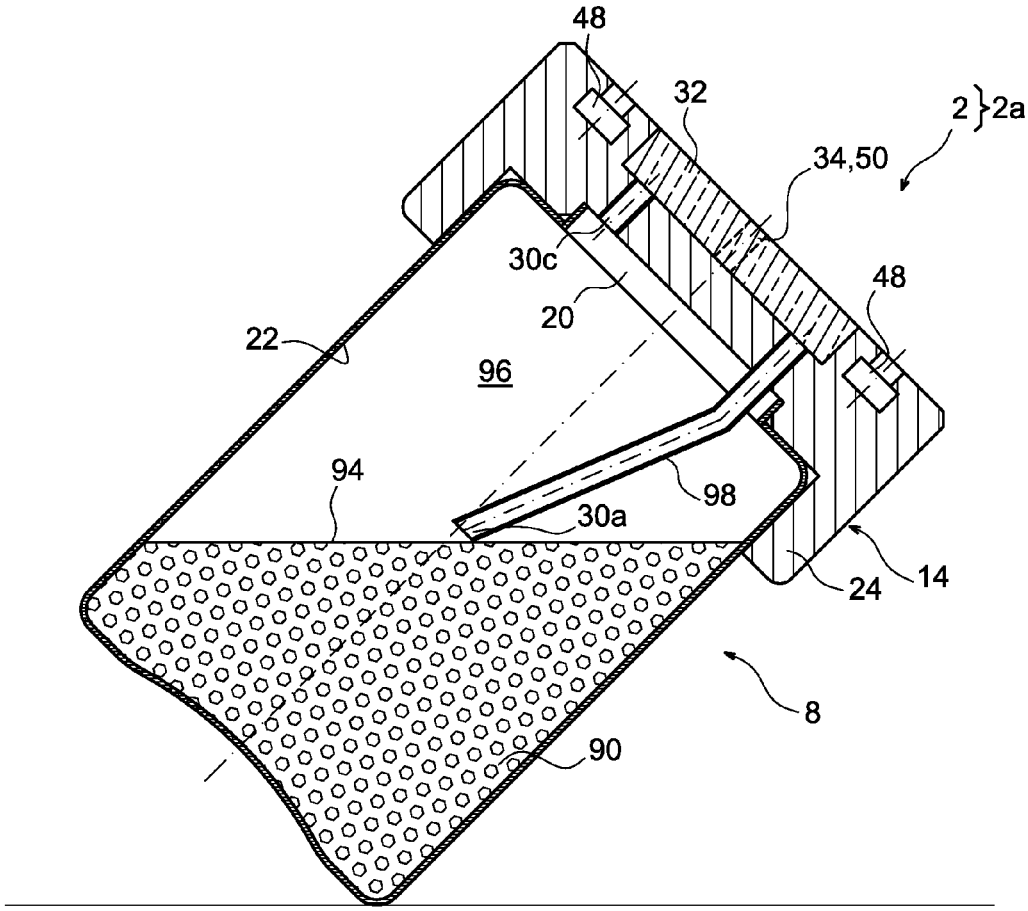
FIG. 4*b* gives a similar view to the view in FIG. 4*a*, with the canister oriented in a tilted position such as may occur under accidental conditions.

Irrespective of the envisaged preferred embodiment, the first orifice 30*a* can be formed differently, in the manner shown in FIGS. 4*a* and 4*b*.

In FIG. 4*a*, part of an assembly 2*a* is shown comprising the packaging device 2 described above, each canister 8 housing in its inner storage space 22 a given volume of radioactive medium 90. The assembly 2*a* is illustrated in normal vertical position in which the axes of the canisters and of the packaging device 2 are substantially orthogonal to the supporting surface 92 of the latter.

The given volume of radioactive medium 90 defines a level forming a horizontal boundary 94 with a gaseous headspace 96 completing the inner storage space 22.

Here, the first orifice 30*a* is initiated in the first shutoff part 24, then extended in a duct 98 projecting from this same part 24 inside the inner storage space 22, in the vicinity of a baric centre of the latter.

More precisely, the first orifice 30*a* is arranged so that it is always in communication with the gaseous headspace 96, irrespective of the spatial orientation of the canister 8 integrating the given volume of medium 90. Therefore, irrespective of the position of the canister 8, at least part of the open end of the first orifice 30*a* is not bathed in the medium 90, so that it is possible at all times to allow the gases produced by radiolysis to escape in the direction of the chamber.

As a result, in the event of accidental conditions in which the device is no longer in normal position for transport/storage, such as shown in FIG. 4*b* as an example, the fluid communication between the gaseous headspace 96 of the canister 8 and the chamber remains maintained, thereby avoiding risks of sudden exceeding of the flammability threshold of the gases contained in the gaseous headspace 96 of the canister.

By way of indication, the maximum ratio between the given volume of medium and the total volume of storage space in which it is contained may be of the order of 0.5.

Also, the ratio between the sum of the volumes of the storage spaces of all the canisters of the packaging device, and the volume of the chamber may be between 0.4 and 0.6.

Evidently, various modifications may be made by persons skilled in the art to the invention just described in non-limiting examples.

The invention claimed is:

1. A packaging device for the transport and/or storage of a radioactive medium generating flammable gases and/or explosives via radiolysis, the said device comprising at least one canister intended to contain the radioactive medium, the said canister defining an inner storage space accessible via an opening for filling of the medium, on which plug-forming means are mounted, characterized in that:

the said device also comprises a structure forming a chamber, and where said canister is arranged outside of said structure forming the chamber, and said canister is removably mounted on an exterior of said structure, and means for placing in communication allowing a first fluid communication to be set up between the said inner storage space and the said chamber.

2. The packaging device according to claim 1, characterized in that:

the canister further comprises a first orifice opening into the inner storage space, in that the said chamber-forming structure comprises a second orifice opening into the said chamber, and in that the said first and second orifices form the two opposite ends of the said first fluid communication.

3. The packaging device according to claim 2, characterized in that the said means for placing in communication comprise a first member mobile between an open position in which it sets up the said first fluid communication, and a second closed position in which it shuts the said second orifice, the said first mobile member being mounted on the said chamber-forming structure.

4. The packaging device according to claim 2, characterized in that:

the canister further comprises a third opening into the inner storage space, in that the said chamber-forming structure comprises a fourth orifice opening into the said chamber, and in that the said means for placing in communication allow a second fluid communication to be set up between the said inner storage space and the said chamber, the said third and fourth orifices forming the two opposite ends of the said second fluid communication.

5. The packaging device according to claim 2, characterized in that:

the canister further comprises a third orifice opening into the inner storage space, in that the said chamber-forming structure comprises a fourth orifice opening into the said chamber, in that the said means for placing in communication allow a second fluid communication to be set up between the said inner storage space and the said chamber, the said third and fourth orifices forming the two opposite ends of the said second fluid communication, and in that a fifth and a sixth orifice are provided in the chamber-forming structure, and communicate with each other via a connecting duct forming an integral part of the said means for placing in communication.

6. The packaging device according to claim 5, characterized in that the said means for placing in communication comprise a first mobile member and a second mobile member each mounted on the said structure forming a chamber and able to be moved between an open position and a closed position, the said first mobile member being designed so that:

in open position, firstly it places in communication the said first orifice with the said fifth orifice, and secondly it sets up the said second fluid communication by placing in communication the said third orifice with the said fourth orifice;

in closed position, firstly it ensures the placing in communication of the fourth orifice with the said fifth orifice, and secondly it prohibits the communication of each of the fourth and fifth orifices with the outside of the said chamber, and in that the said second mobile member is designed so that:

in open position, firstly it places in communication the said sixth orifice with the outside of the said chamber, and secondly it places the said second orifice in communication with the outside of the said chamber;

in closed position, firstly it ensures the placing in communication of the sixth orifice with the said second orifice, and secondly it prohibits the communication of each of the second and sixth orifices with the outside of the said chamber.

7. The packaging device according to claim 3, characterized in that the said canister comprises an additional first mobile member, mobile between an open position in which it sets up the said first fluid communication, and a closed position in which it shuts the said first orifice, either one of the first mobile member and additional first mobile member being a leading member and the other a follower member of the actuating member, so that the movement of the actuating member from its closed position to its open position leads the said follower member also to move from its closed position to its open position, and conversely.

8. The packaging device according to claim 7, characterized in that the said actuating member also forms a mechanical connection member for the said canister on the chamber-forming structure.

9. The packaging device according to claim 8, characterized in that the said actuating member is designed so that its movement from its closed position to its open position, with the said canister bearing upon the first mobile member, ensures a mechanical connection of the canister, and so that the movement from its open position to its closed position ensures mechanical disconnection of this canister.

10. The packaging device according to claim 9, characterized in that the said actuating member forms a male or female part of a bayonet mechanical connection.

11. The packaging device according to claim 1, characterized in that it comprises a plurality of canisters each associated with means for placing in communication allowing a first fluid communication to be set up between its inner space and the said chamber.

12. The packaging device according to claim 11, wherein the means for placing in communication of all the canisters share the same second orifice, and a second mobile member is designed so that:

in open position, firstly it places in communication each of sixth orifices with the outside of the said chamber, and secondly it places the said single second orifice in communication with the outside of the said chamber;

in closed position, firstly it ensures the placing in communication of each of the sixth orifices with the said single second orifice, and secondly it prohibits the communication of the single second orifice and of each of the sixth orifices with the outside of the said chamber.

13. An assembly comprising the said packaging device according to claim 1, each canister housing in its inner storage space a given volume of radioactive medium, defining a level forming a horizontal boundary line with a gaseous headspace completing this inner storage space, the said means for placing in communication associated with the said canister having a first orifice opening into the said inner storage space, and arranged so that at all times it is in communication with the gaseous headspace, irrespective of the spatial orientation of the said canister integrating the said given volume of medium.

14. The assembly according to claim 13, characterized in that the said first orifice is provided at least in part in a duct projecting inside the said inner storage space.

15. The assembly according to claim 14, characterized in that the said first orifice opens in the vicinity of a baric centre of the said inner storage space.

16. A package for the transport and/or storage of a radioactive medium, characterized in that it comprises an overpack forming a cavity inside which an assembly according to claim 13.

17. Container for the transport and/or storage of a radioactive medium, characterized in that it comprises an overpack forming a cavity inside which a packaging device according to claim 1 is housed.

18. A method for packaging a radioactive medium in a device according to claim 1, wherein:

the radioactive medium is introduced into the inner storage space of the canister;

the canister is sealed using plug-forming means; and the said first fluid communication is set up between the said inner storage space and the said chamber.

* * * * *